US011311983B2

(12) United States Patent
Brahmbhatt

(10) Patent No.: US 11,311,983 B2
(45) Date of Patent: Apr. 26, 2022

(54) MULTI-PURPOSE TOOL FOR USE WITH GAS CYLINDERS

(71) Applicant: Sudhir R. Brahmbhatt, Glencoe, MO (US)

(72) Inventor: Sudhir R. Brahmbhatt, Glencoe, MO (US)

( * ) Notice: Subject to any disclaimer, the term of this patent is extended or adjusted under 35 U.S.C. 154(b) by 337 days.

(21) Appl. No.: 16/794,362

(22) Filed: Feb. 19, 2020

(65) Prior Publication Data

US 2021/0252673 A1 Aug. 19, 2021

(51) Int. Cl.
*B25B 13/02* (2006.01)
*B25B 13/48* (2006.01)

(52) U.S. Cl.
CPC ..... *B25B 13/02* (2013.01); *B25B 13/48* (2013.01)

(58) Field of Classification Search
CPC ..... B25B 13/48; B25B 13/481; B25B 13/485; B25B 13/50; B25F 1/00
See application file for complete search history.

(56) References Cited

U.S. PATENT DOCUMENTS 4,741,060 A * 5/1988 Hose ..... B25B 13/02 7/138
6,450,069 B1 9/2002 Brahmbhatt
2015/0198405 A1* 7/2015 Keng ..... F41C 27/00 42/108
2018/0085610 A1* 3/2018 Aroonsawat ..... B25B 13/5091
2018/0215027 A1* 8/2018 Holm, Jr. ..... B25F 1/00
2019/0022847 A1* 1/2019 Weathers ..... B25B 13/04

FOREIGN PATENT DOCUMENTS

CN 108942761 A * 12/2018

* cited by examiner

*Primary Examiner* — David B. Thomas
(74) *Attorney, Agent, or Firm* — William H. Eilberg

(57) ABSTRACT

A tool, for opening a variety of valves associated with gas cylinders, includes an elongated body. One end of the body defines a hook. The body has a generally square cut-out extending through the thickness of the body. The body also includes two or three threaded holes which enable a set of threaded pins to be screwed into the holes. The body also includes an opening defining regions of distinct widths. The tool can be used to remove or insert a cap or cover on a gas cylinder, to operate a valve of a welding gas cylinder, to open or close a nut or fitting associated with a gas cylinder, and to open or close a valve wheel associated with a gas cylinder. The tool thus simplifies the management of gas cylinders, by reducing or eliminating the need for auxiliary tools such as wrenches and hammers.

16 Claims, 6 Drawing Sheets

MULTI-PURPOSE TOOL FOR USE WITH GAS CYLINDERS

BACKGROUND OF THE INVENTION

The present invention is a tool which is useful for opening and closing valves and covers associated with gas cylinders.

Gas cylinders or tanks are used in many settings, including factories, hospitals, laboratories, and also in homes. Industrial cylinders may contain gases which are dangerous. Medical cylinders used in the home, or in a hospital or other medical facility, typically contain oxygen, for use in helping a patient to breathe.

In all such environments, there are problems associated with the use of gas cylinders. A gas cylinder may contain a cap or cover which is very tightly fitted over the main cylinder valve, and the cap may be difficult or impossible to remove without a tool. The cylinder itself may have one or more different kinds of valves, including those which are operated by turning a wheel, and those operated by turning a nut or a fitting. There are a variety of such valves and valve wheels, having different sizes, and it is usually necessary to provide multiple tools, typically including a set of wrenches and hammers, to open and close all such valves and wheels.

U.S. Pat. No. 6,450,069, the disclosure of which is incorporated by reference herein, shows a multi-purpose wrench for gas cylinders. The patented wrench solves some of the problems described above.

The present invention provides a significant further improvement over the above-mentioned patented wrench. The tool of the present invention enables one to open and close various caps and valves, associated with gas cylinders, without the need to provide auxiliary tools such as wrenches and hammers. The invention therefore greatly simplifies the management of gas cylinders, replacing a potentially large set of tools with a single tool.

SUMMARY OF THE INVENTION

The present invention comprises a tool for use with a gas cylinder. The tool has an elongated body having first and second ends. A part of the first end is shaped as a hook. The body has a generally square cut-out which extends entirely through the thickness of the body. The body also has a plurality of threaded holes, in the vicinity of the second end, the holes being adapted to receive threaded pins which may be easily screwed into the body or removed from the body. The body also has an opening, in the vicinity of the second end, the opening defining a region which has at least two distinct widths.

The hook formed on the body is used to grasp an opening of a cylinder cap, thereby enabling a user to unscrew the cap from the cylinder, or to replace the cap on the cylinder.

The square cut-out is designed to accommodate a valve pin having a square cross-section, such valve pin being commonly used on cylinders for welding gases.

When threaded pins are screwed into the threaded holes, the tool can be used to open or close a cylinder valve wheel, by engaging the pins in the grooves of the wheel.

The opening having multiple widths is used to engage a nut or fitting, which is typically found on a fluid line attached to a gas cylinder.

Because the tool can accommodate many different valves and covers, the tool virtually eliminates the need for additional tools, such as wrenches and hammers, for use in managing gas cylinders.

The present invention therefore has the primary object of providing a tool for opening and closing valves associated with gas cylinders.

The invention has the further object of providing a tool for opening and closing a cap or cover on a gas cylinder valve.

The invention has the further object of providing a tool for opening and closing a valve on a welding gas cylinder.

The invention has the further object of providing a tool which can open or close a large variety of cylinder valve wheels.

The invention has the further object of providing a tool which can open and close various nuts or fittings associated with gas cylinders.

The invention has the further object of simplifying the management of gas cylinder valves.

The invention has the further object of reducing the cost, and improving the safety, of the management of gas cylinders.

The invention has the further object of providing a unitary tool for opening and closing valves of gas cylinders, which tool can be conveniently stored.

The reader skilled in the art will recognize other objects and advantages of the present invention, from a reading of the following brief description of the drawings, the detailed description of the invention, and the appended claims.

DETAILED DESCRIPTION OF THE INVENTION

Figure 1:
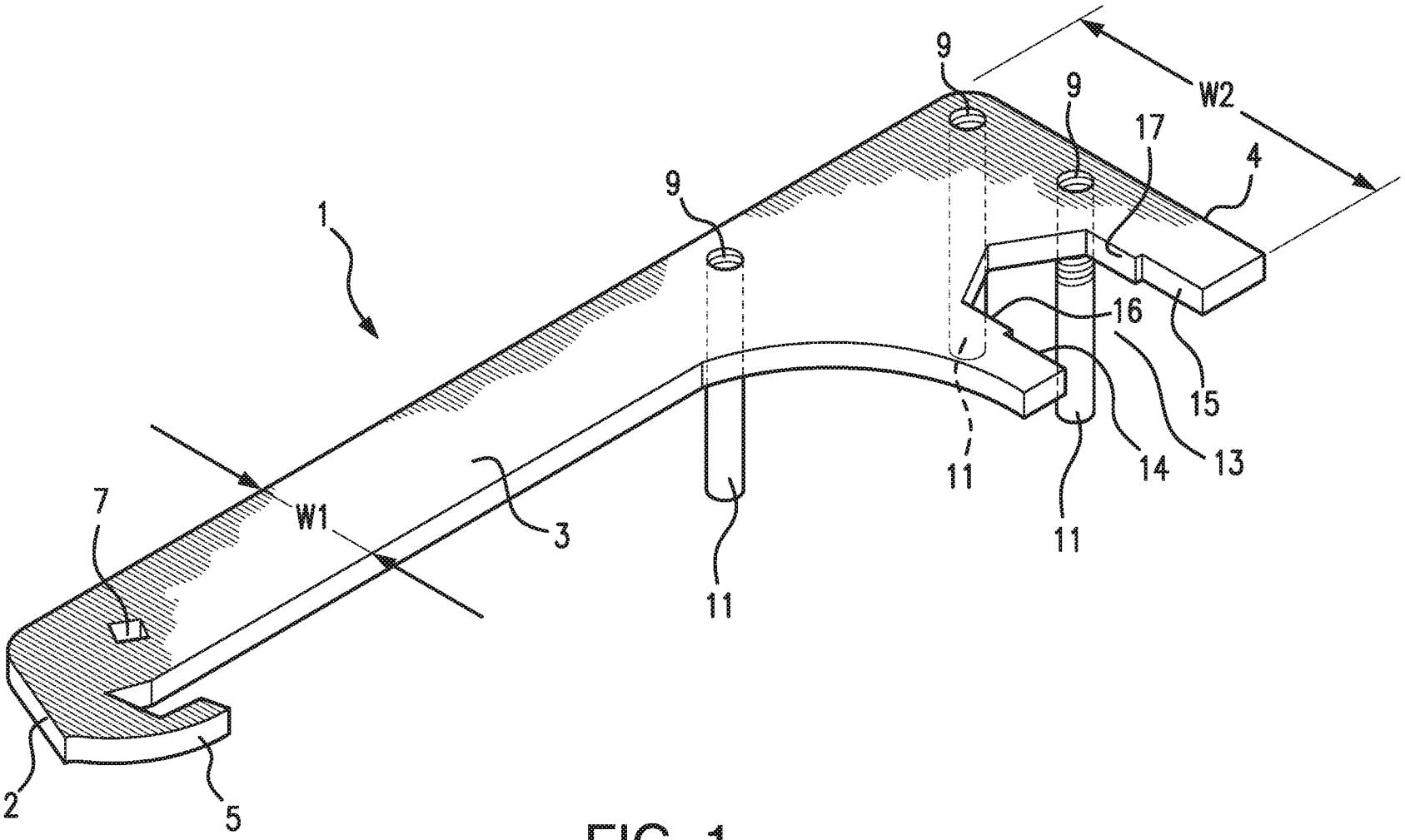
FIG. 1 provides a perspective view of the tool of the present invention, in which portions of the pins, used with the tool, are shown in dotted outline.

FIG. 1 provides a perspective view of the tool 1 of the present invention. The tool comprises an elongated body 3, formed of a unitary piece of material having a generally uniform thickness. The body may be made of metal, or it could be made of hard plastic, or other equivalent material.

The body 3 has first end 2 and second end 4. The part of the body closer to the first end 2 has a transverse dimension W1 which is generally constant along most of the length of the tool, but which increases in the vicinity of the second end 4, to a maximum value designated by W2.

The tool body 3 includes the following features:

a) a hook 5, located near the first end of the body;

b) a generally square cut-out 7, located near the first end of the body, the cut-out extending entirely through the thickness of the body, thus comprising a square hole;

c) a set of three threaded holes 9, the holes being positioned near the second end of the body, the threaded holes enabling threaded pins 11 to be screwed into the holes; and d) an opening 13, located at the second end of the body, the opening defining a region having at least two different widths.

With regard to the hook 5, it should be noted that the hook is preferably integrally formed with the body. That is, part of the first end 2 of the body is shaped as a hook.

The body defines upper and lower planar surfaces, only the upper surface being visible in FIG. 1. Being integral with the body, the hook similarly has upper and lower planar surfaces which are co-planar with the respective upper and lower surfaces of the body. Thus, the tool can be stored in a narrow space having a width which is almost as small as the thickness of the body, provided that the pins 11 have been removed.

With regard to opening 13, it is seen from FIG. 1 that opening 13 defines opposing surfaces 16 and 17, and 14 and 15. The distance between surfaces 16 and 17 is less than the distance between surfaces 14 and 15. Thus, in the example shown, the opening defines regions of two distinct widths. The tool could be constructed such that there are more than two distinct widths defined in opening 13.

In the elongated body 3 shown in FIG. 1, the transverse dimension becomes gradually larger as one proceeds towards the second end 4. This gradual increase in size of the transverse dimension provides more material to accommodate the pins 11 and the opening 13.

Figure 2:
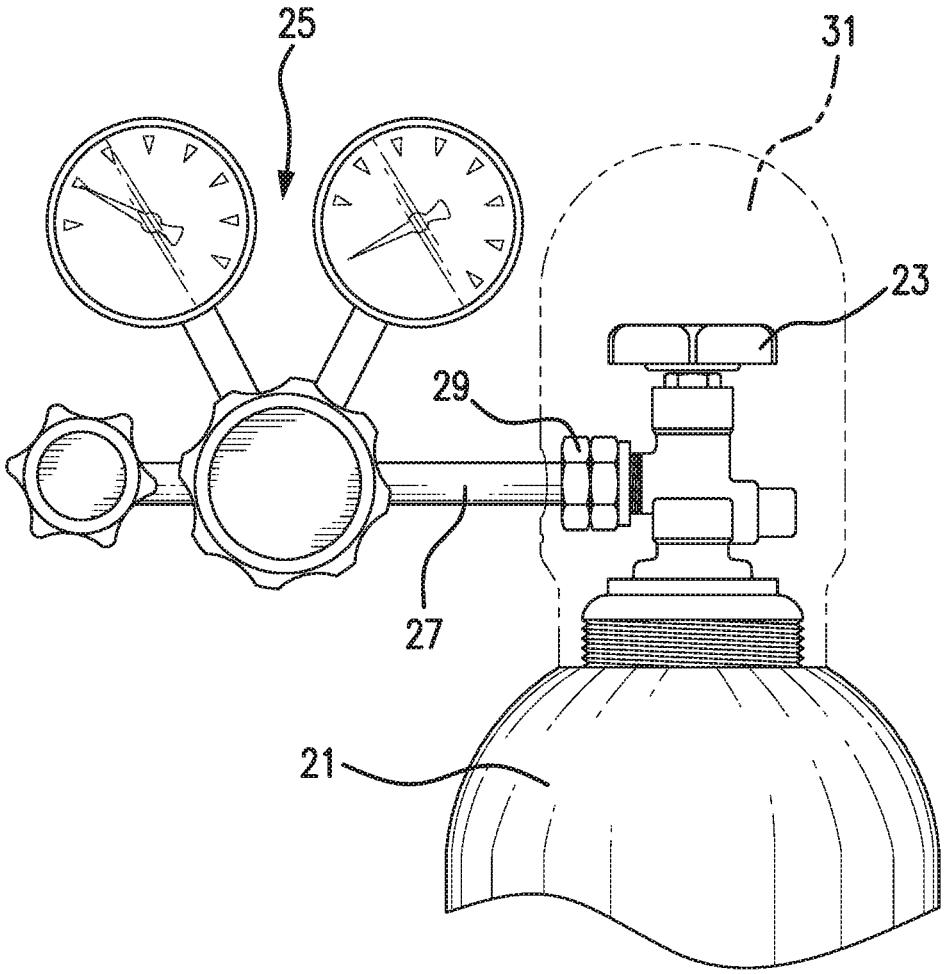
FIG. 2 PRIOR ART
FIG. 2 provides a fragmentary elevational view of a portion of a prior art gas cylinder, the view showing valves attached to the cylinder, a fluid connection to pressure-regulating devices, and a cylinder cap shown in dotted outline.

The use of the tool of the present invention will be described, in part, with reference to the prior art structure shown in FIG. 2. FIG. 2 shows gas cylinder 21 having a cylinder valve wheel 23. The cylinder is connected to regulator apparatus 25 by conduit 27. The fluid flow in conduit 27 is controlled by a valve which is opened and closed by rotating nut or fitting 29. The wheel 23 and fitting 29 are encased within cylinder cap 31.

Figure 3:
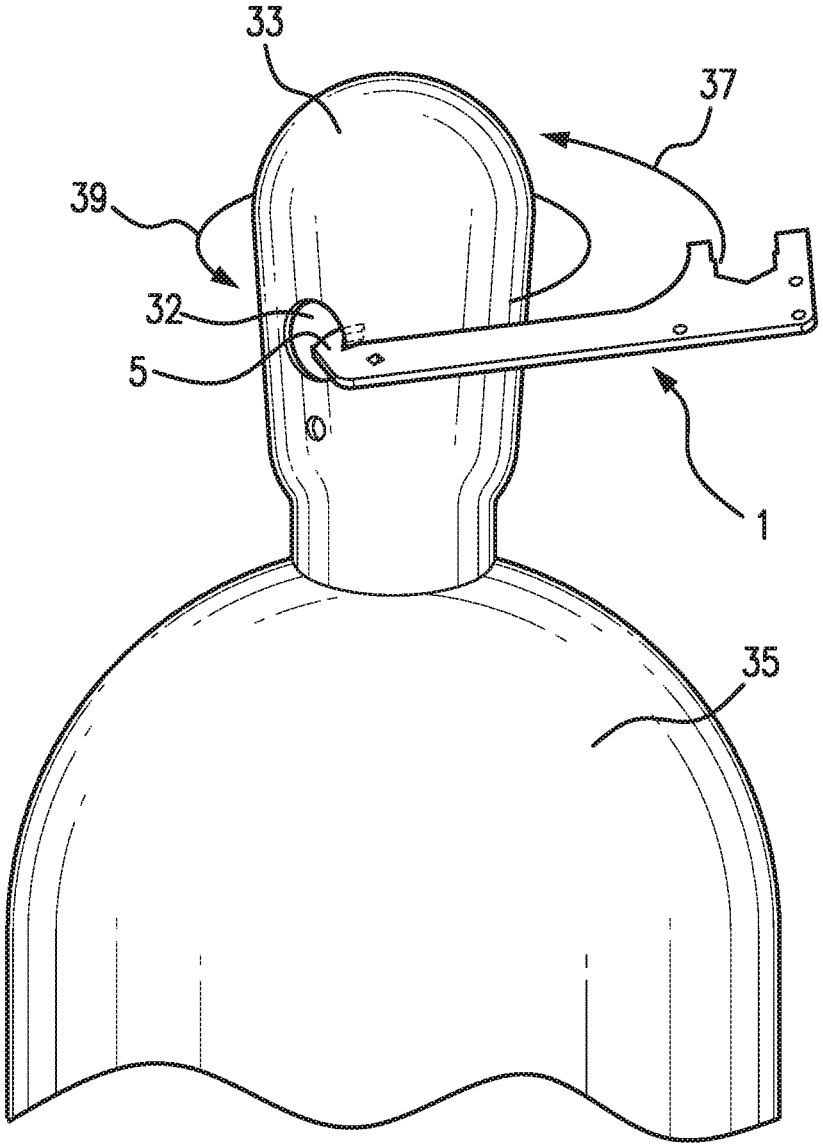
FIG. 3 provides a fragmentary elevational view of a gas cylinder, showing the tool of the present invention as it is used to open a cylinder cap.

FIG. 3 shows the use of the tool of the present invention in opening a cylinder cap. As shown in the figure, the hook 5 of tool 1 engages opening 32 in cap 33 of cylinder 35. Cap 33 is comparable to cap 31 of FIG. 2. The tool 1 is rotated by hand, in the direction indicated by arrow 37, causing the cap 33 to rotate as indicated by arrow 39. The cap 33 is attached to the cylinder 35 by a threaded connection, the threads not being visible in the figure. The tool 1 therefore enables a user to unscrew the cap 33, in a manner analogous to the process of unscrewing a cap from a soda bottle. The tool 1 could also be used to replace the cap, if desired, after the cylinder has been used, by rotating the cap in the other direction.

Figure 4:
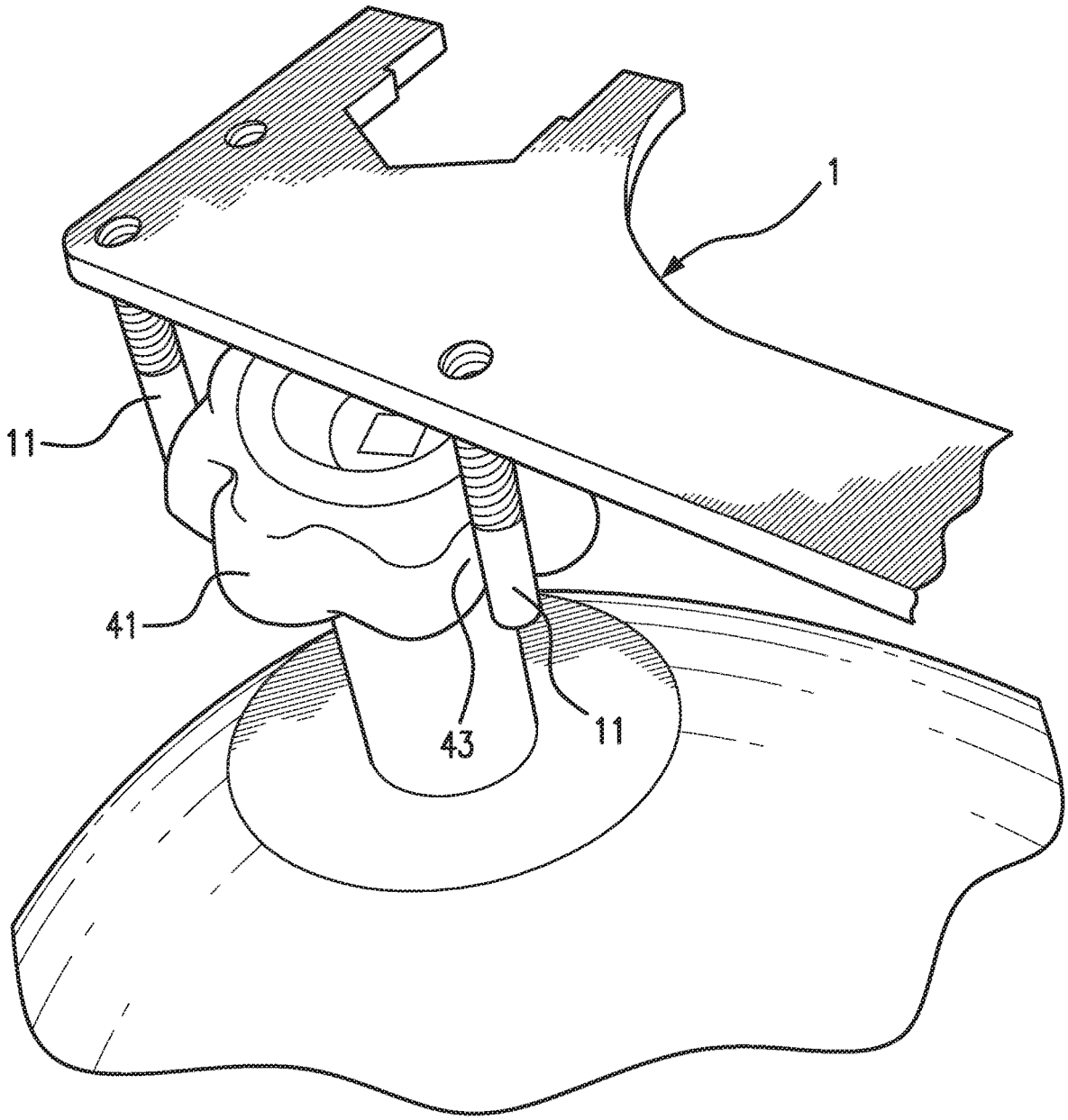
FIG. 4 provides a fragmentary perspective view, showing the tool of the present invention as it engages a cylinder valve wheel.

FIG. 4 shows the use of the tool of the present invention in opening a cylinder valve wheel. The figure shows tool 1 with pins 11 attached. The cylinder valve wheel 41 is of the type having protrusions and recesses or grooves, and is comparable to the valve wheel 23 shown in FIG. 2. By inserting the pins in the appropriate grooves of the wheel, such as groove 43 in FIG. 4, the pins can be made to engage the wheel securely. Then, by simply applying torque to the tool, by hand, one can open or close the valve.

An important feature of the present invention is that the tool has only two or three pins. By minimizing the number of pins used, one maximizes the number of different sizes of valve wheels which can be engaged by the set of pins. That is, reducing the number of pins improves the versatility of the tool, because the tool can now engage a larger number of different types and sizes of valve wheels. Indeed, if the wheel has alternating protrusions and grooves, a tool having even only two pins may be sufficient for engagement with the wheel.

Figure 5:
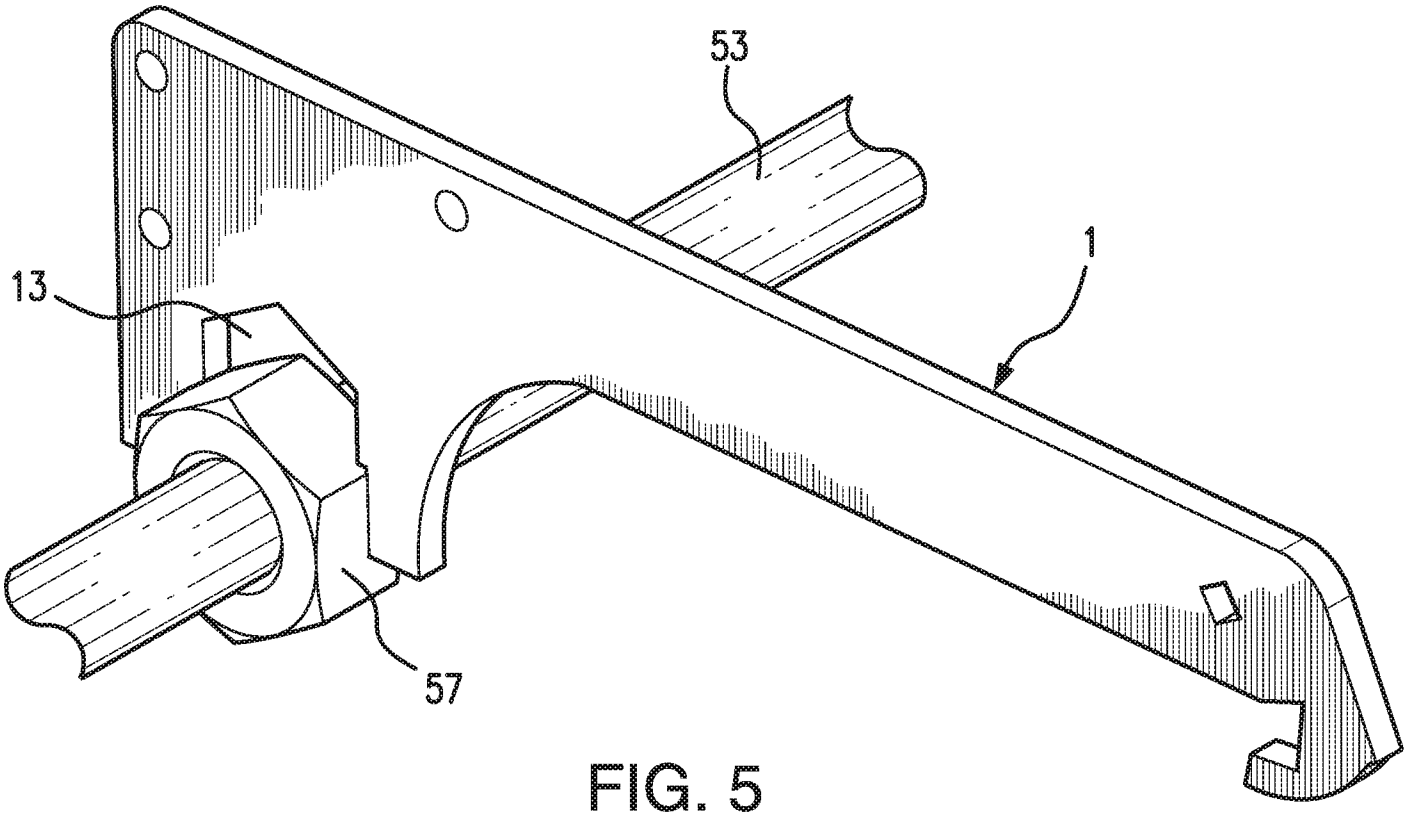
FIG. 5 provides a fragmentary perspective view, showing the tool of the present invention in engagement with a fitting or nut such as that found attached to the cylinder of FIG. 2.

FIG. 5 illustrates the use of the tool of the present invention in opening or closing a nut or fitting for a regulator or other device. The nut or fitting is comparable to fitting 29 of FIG. 2. FIG. 5 shows, in fragmentary perspective form, a fitting 57, having the form of a nut, disposed on a fluid conduit 53. The tool 1 engages the fitting 57 by use of the opening 13. As noted above, the opening 13 defines areas of different widths, intended to engage nuts or fittings of different sizes. In the example of FIG. 5, the opening defines a region of a larger width and a smaller width, the fitting 57 occupying the space provided by the region of the larger width. After the tool has been engaged with the fitting or nut, the tool can be rotated by hand, thereby rotating the fitting, and opening or closing an associated valve.

Figure 6:
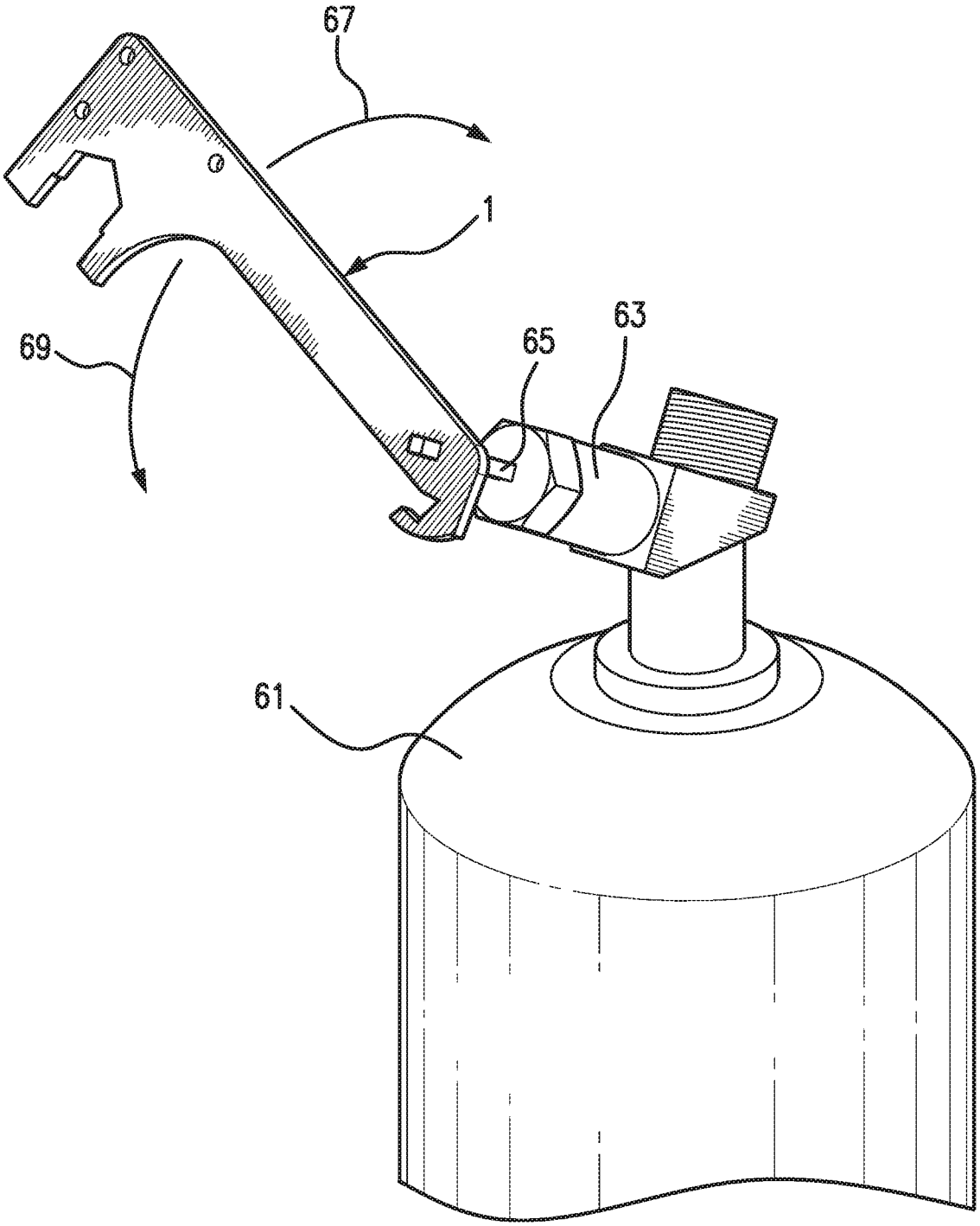
FIG. 6 provides a fragmentary perspective view, showing the tool of the present invention in engagement with a valve stem for a welding gas cylinder.

FIG. 6 shows the use of the tool in opening or closing a valve of a welding gas cylinder. The figure shows a cylinder 61 having a valve 63 which includes a valve controlled by valve pin 65. The pin 65 has a square cross-section, such that the pin fits snugly within square cut-out 7 of the tool 1 (see FIG. 1). When the cut-out has been fully engaged with the valve pin 65, as shown in FIG. 6, the tool 1 can be rotated by hand, in either direction, as shown by arrows 67 and 69, to open or close the valve.

In a preferred embodiment, the tool body may have a thickness of 3/16 inch. As shown in the drawings, this thickness is substantially uniform throughout the tool body. The threaded pins may be 1.5 inches in length, and ¼ inches in diameter. The pins may be threaded only along half of their length. The dimensions mentioned herein are given only by way of example, and not by way of limitation. The invention is not intended to be limited to any particular set of dimensions.

The tool of the present invention can be made of a material which resists bacterial contamination, or which resists sparks, or both. Bronze is an example of a material which has both of these properties, and which can be used as a material for the present tool. The tool of the invention could also be made to be resistant to bacteria, but not spark-free, or resistant to sparks, but not resistant to bacteria. The invention is not intended to be limited by the material used in constructing the tool. Examples of materials which could be used to make the tool include, without limitation, bronze, hard plastic, stainless steel, carbon steel, or some other metal.

The tool of the present invention is preferably packaged with the threaded pins, but wherein the pins are not yet inserted. Such an arrangement makes it easy to store the tool, because the tool body then has a very thin profile, as noted above, and can fit in relatively narrow spaces. The tool can be easily stored near a cylinder, or it can be suspended from an appropriate protrusion attached to a cylinder, perhaps using the square cut-out 7 as an attachment means.

The tool of the present invention therefore solves the problems encountered in opening and closing gas cylinders, by providing multiple functions in a single tool. The present invention thereby reduces or eliminates the need for a plurality of wrenches, hammers, and other tools.

The invention may be modified in ways that will be apparent to those skilled in the art. For example, the number of different diameters defined by opening 13 could be varied. As noted above, the invention can be practiced with two or three pins, though preferably with not more than three.

It is also possible to vary the position of certain components of the tool of the present invention. For example, the square cut-out 7 could be positioned at a different location on the tool from what is shown in the figures. Similarly, the pins and the threaded holes could be positioned differently.

These and other modifications should be considered within the spirit and scope of the following claims.

What is claimed is:

1. A tool for use with a gas cylinder, comprising:

a) an elongated body defining first and second ends, b) a hook formed at the first end of the body, c) the body including a generally square cut-out which extends entirely through a thickness of the body, d) a plurality of threaded holes, disposed in a vicinity of the second end of the body, and e) an opening, disposed in a vicinity of the second end of the body, the opening defining a region having at least two distinct widths.

2. The tool of claim 1, wherein the body of the tool has a transverse dimension which increases towards the second end of the body.

3. The tool of claim 1, further comprising a plurality of threaded pins, sized to be insertable, by screwing, into the threaded holes.

4. The tool of claim 1, wherein the body comprises a unitary piece.

5. The tool of claim 1, wherein the hook is integrally formed with the body.

6. The tool of claim 1, wherein the hook is integral with the body, wherein the hook has an upper surface which is co-planar with an upper surface of the body, and wherein the hook has a lower surface which is co-planar with a lower surface of the body.

7. A tool for use with a gas cylinder, comprising:

an elongated body having a generally uniform thickness, a part of the body having a hook, the body including a generally square hole extending through the entire thickness of the body, the body including a plurality of threaded holes, the body defining an opening which defines regions of distinct widths.

8. The tool of claim 7, wherein the body has first and second ends, wherein the hook is located at the first end, wherein the square hole is located in a vicinity of the first end, wherein the threaded holes are located in a vicinity of the second end, and wherein the opening is located in a vicinity of the second end.

9. The tool of claim 7, further comprising a plurality of threaded pins, sized to be screwed into the threaded holes.

10. The tool of claim 9, wherein the body has a transverse dimension which is generally constant in a vicinity of the first end, and which gradually increases towards the second end.

11. The tool of claim 7, wherein the hook is integrally formed with the body.

12. The tool of claim 11, wherein the hook has an upper surface which is co-planar with an upper surface of the body, and wherein the hook has a lower surface which is co-planar with a lower surface of the body.

13. A tool for use with a gas cylinder, comprising:

an elongated body having a generally uniform thickness, a part of the body having a hook, the body including a plurality of threaded holes, the body defining an opening which defines regions of distinct widths.

14. The tool of claim 13, further comprising a plurality of threaded pins, sized to be screwed into the threaded holes.

15. The tool of claim 14, wherein the body has a transverse dimension which is generally constant in a vicinity of the first end, and which gradually increases towards the second end.

16. The tool of claim 13, wherein the hook is integrally formed with the body, wherein the hook has an upper surface which is co-planar with an upper surface of the body, and wherein the hook has a lower surface which is co-planar with a lower surface of the body.

* * * * *